US005195502A

United States Patent [19]

Hanning

[11] Patent Number: 5,195,502

[45] Date of Patent: Mar. 23, 1993

[54] DOWN-FIRED U-TUBE WATER HEATER

[75] Inventor: David M. Hanning, Montgomery, Ala.

[73] Assignee: Rheem Manufacturing Company, New York, N.Y.

[21] Appl. No.: 862,292

[22] Filed: Apr. 2, 1992

[51] Int. Cl.[5] ..... F24H 1/20

[52] U.S. Cl. ..... 126/360 R; 29/890.051; 122/17

[58] Field of Search ..... 126/366, 368, 360 R; 122/17, 19, 32, 33; 29/890.051

[56] References Cited

U.S. PATENT DOCUMENTS

| | | | |
|---|---|---|---|
| 2,495,673 | 4/1945 | Erwin | 126/360 |
| 2,543,835 | 12/1945 | Dewey | 126/360 |
| 4,492,185 | 1/1985 | Kendall et al. | 122/32 |
| 4,660,541 | 4/1987 | Moore | 126/360 |
| 4,685,425 | 8/1987 | Eising | 122/17 |
| 4,699,122 | 10/1987 | Jannemann et al. | 126/362 |
| 4,771,762 | 9/1988 | Bridegum | 126/360 R |
| 4,981,112 | 1/1991 | Adams et al. | 122/19 |

*Primary Examiner*—Edward G. Favors
*Attorney, Agent, or Firm*—Konneker & Bush

[57] ABSTRACT

A down-fired water heater has a top storage tank head portion with a central opening bordered by an upstanding annular flange. Welded within this flanged opening is a generally pan-shaped tube sheet structure having an open top side, and a bottom side wall in which a spaced pair of openings are formed. The open top ends of a U-tube immersion heating member, formed from a single length of metal tubing, are upwardly received and welded within these openings. During water heater operation, a top mounted shot-type fuel burner downwardly injects a flame, and resulting hot combustion gases, into one of the open upper ends of the U-tube. A top mounted draft inducer fan, with an inlet communicated with the interior of the tube sheet structure, draws the combustion gases through the U-tube and into the tube sheet interior via the other open tube end, and then discharges the combustion gases outwardly away from the water heater. The induced two-pass flow of combustion products through the tank interior very efficiently heats water stored therein and evenly distributes combustion heat along the height of the stored water. In an alternate embodiment thereof, the top head portion is upwardly domed, and its flanged opening and the tube sheet structure are eliminated. Openings are extended through a spaced pair of flattened areas on the top head portion, and the upper ends of the U-tube are inserted into and welded within such openings.

20 Claims, 1 Drawing Sheet

DOWN-FIRED U-TUBE WATER HEATER

BACKGROUND OF THE INVENTION

The present invention relates generally to heating apparatus, and more particularly relates to fuel-fired water heating appliances such as water heaters and boilers.

Conventional fuel fired water heaters are typically provided with "up-flow" firing configurations in which upper and lower tube sheet structures are secured at the top and bottom ends of the metal storage tank portion of the water heater. The open upper and lower ends of a spaced series of submerged vertical heating flues are respectively secured to these upper and lower tube sheets and receive an upward throughflow of hot combustion gases generated by a fuel burner structure disposed beneath the lower tube sheet. These upwardly flowing combustion gases serve to heat water stored in the tank for on-demand outflow therefrom to the various plumbing fixtures served by the water heater. The combustion gases upwardly exiting the vertical flues are discharged to ambient through a suitable vent pipe.

Despite the wide acceptance and use of this upflow configuration in fuel-fired water heaters, it presents a variety of well known problems, limitations and disadvantages. For example, the single upward pass of hot combustion gases through the tank water tends to provide a relatively low combustion gas-to-water heat exchange efficiency rate.

Additionally, various fabricational complexities associated with conventional upflow water heaters tend to undesirably add to their overall manufacturing cost. As an example, the necessity of providing both top and bottom tube sheets requires that numerous welds be formed to operatively secure both the top and bottom ends of the flues to their associated tube sheets. Moreover, the presence of the bottom tube sheet complicates the formation of the usual outer jacket insulation structure that encapsulates the storage tank. During the placement of the insulation around the tank, auxiliary insulation stop structures must typically be utilized. Also, a bottom skirt structure is normally required in conjunction with the bottom end burner used in these upflow water heaters.

In response to these problems associated with upflow water heaters, various solutions have heretofore been proposed in the prior art, including the construction of water heaters in downflow configurations in which the burner is mounted on the top of the water heater, and the hot combustion gases generated by the top-mounted burner are downwardly flowed through a series of vertical flues submerged within the storage tank. While this reversed configuration typically positions the burner on top of the tank, it still requires considerable welding since both an upper tube sheet and a lower tube sheet are needed. Additionally, insulation stops are still required, due to the presence of the lower tube sheet, and the single pass of hot combustion gases through the tank water keeps the overall combustion gas-to-water heat exchange efficiency at a relatively low level.

Another approach used in the prior art in an attempt to reduce the various problems associated with upflow firing configurations in water heaters is to provide what may be designated a horizontal, multi-pass firing configuration. Under this approach, a multi-pass immersion heater structure is extended horizontally into the storage tank interior through an side wall opening formed therein, and the burner is mounted on an exterior side portion of the water heater. The immersion heating structures used in this approach tend to be rather complicated from a manufacturing standpoint, and the overall heating structure still tends to interfere with the jacket insulation forming process. Additionally, the heat input to the tank water tends to be undesirably concentrated in a vertically intermediate portion of the tank interior.

Yet another approach attempted in the prior art, illustrated in the 1945 U.S. Pat. No. 2,543,835 to Dewey, is to provide a down fired, multi-pass immersion heating structure in which the hot combustion gases downwardly enter and then upwardly exit the tank interior. The Dewey immersion heating structure is removably secured to the upper end of a liquid heating vessel and comprises a spaced pair of vertical inlet and discharge flues connected at their lower ends to rectangular header boxes that are joined by a plurality of rectangularly cross-sectioned horizontal flues. The upper end of the inlet flue is connected to a burner structure, and the upper end of the discharge flue is connected to the inlet of a suction fan.

Despite its top burner mounting and multi-pass combustion gas flow routing, the Dewey immersion heater structure is not well suited for use in modern mass produced residential or commercial water heaters for a variety of reasons. For example, the headered immersion heater structure is of a relatively complicated (and thus expensive) configuration requiring that several welding steps be performed to operatively interconnect the necessary cylindrical inlet and discharge flues, the rectangular headers, and the multi-channel horizontal bottom flue structure. Also, the multi-piece nature of the Dewey immersion heater structure undesirably places a series of heater joints within the liquid vessel. Furthermore, the heater structure is designed to be removed for cleaning, thereby requiring a dual flanged interconnection between a top end portion of the liquid vessel and the flat top plate to which the immersion heater structure is secured.

It can be seen from the foregoing that a need exists for an improved fuel fired water heater that is simpler, less expensive to manufacture and more fuel efficient than conventional upflow water heaters, and that also eliminates or at least substantially reduces the problems, limitations and disadvantages typically associated with prior art alternatives to upflow water heaters. It is accordingly an object of the present invention to provide such an improved fuel fired water heater.

SUMMARY OF THE INVENTION

In carrying out principles of the present invention, in accordance with a preferred embodiment thereof, an improved down-fired water heater is provided that includes a specially designed metal storage tank and associated U-tube immersion heating subassembly. The storage tank includes a tank body having open upper and lower ends, a bottom head portion having a peripheral lip, and a top head portion having a downwardly extending peripheral lip and a central opening bordered by an upwardly projecting flange. The tank is formed by respectively inserting the lip portions of the top and bottom head portions into the upper and lower tank body ends and then welding the inserted lip portions to the tank body, and the tank is preferably encapsulated within an insulation jacket structure.

The heating subassembly includes a generally pan-shaped metal tube sheet structure having an open top side, and a bottom side wall through which spaced apart first and second openings upwardly extend. Extending downwardly from the tube sheet structure is a U-tube immersion heating member formed from a single length of metal tubing. The U-tube has first and second open upper ends upwardly and respectively received in the first and second tube sheet structure openings and welded to the bottom side wall of the tube sheet structure.

Either before or after the top head portion is welded to the tank body, the heating subassembly is operatively secured to the top head portion by simply inserting the tube sheet structure into the flanged central opening of the top head portion, in a manner such that the U-tube will extend downwardly into the tank interior, and then welding the peripheral side wall of the tube sheet structure to the upwardly extending flange on the top head portion.

Burner means, positioned atop the insulated tank, are provided for flowing a flame, and resulting hot combustion gases, downwardly into the first open upper end of the U-tube. Forced draft means, representatively in the form of a draft inducer fan, are also provided, and are operative to draw combustion gases through the downwardly extending U-tube, and outwardly through its second open upper end, and then discharge the combustion gases outwardly away from the water heater. During operation of the water heater, the hot combustion products make two vertical passes through water stored in the tank and efficiently transfer heat thereto through the U-tube, the transferred heat being evenly distributed heightwise within the tank water.

According to a feature of the present invention, the burner means and the draft inducer fan are disposed within a housing mounted on the upper end of the insulated tank. The draft inducer fan inlet is spaced apart from the second open upper end of the U-tube and communicated with the interior of the tube sheet structure in a manner such that during water heater operation the draft inducer fan means withdraws therefrom combustion gases upwardly exiting the second open upper end of the U-tube. The tube sheet structure thus also functions as a combustion gas collection pan during water heater operation.

In an alternate embodiment of the water heater the single tube sheet structure and the flanged central opening in the top tank head portion are eliminated. The top head portion is provided with an upwardly domed configuration and has spaced apart, upwardly facing flattened areas formed thereon through which a pair of openings upwardly extend. The open upper ends of the U-tube are inserted into these openings and welded directly to the top head portion. In this alternate embodiment of the water heater, the draft inducer fan inlet may be directly connected to the second open upper end of the U-tube.

The overall structures and fabrication methods associated with these two water heater embodiments significantly facilitate the rapid, relatively inexpensive mass production of domestic and commercial down-fired water heaters and at the same time provide water heaters that are more energy efficient than conventional up-fired water heaters.

DETAILED DESCRIPTION

Figure 1:
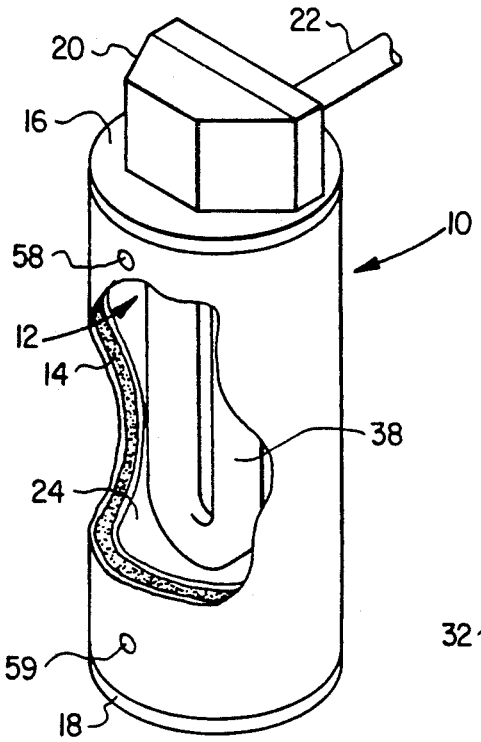
FIG. 1 is a partially cut away perspective view of a down fired U-tube water heater embodying principles of the present invention.

Perspectively illustrated in FIG. 1 is an induced draft, down fired U-tube water heater 10 that embodies principles of the present invention and includes a vertically oriented cylindrical metal water storage tank structure 12 surrounded by an insulation jacket 14 to which top and bottom end caps 16,18 are suitably secured. Mounted atop the end cap 16 is a fan and burner housing 20 from which a horizontally oriented combustion gas vent pipe 22 outwardly extends.

Figure 3:
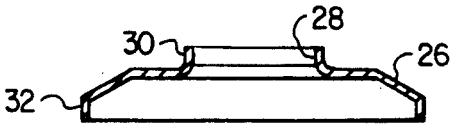
FIG. 3 is a cross-sectional view through a top storage tank end portion of the water heater.
Figure 4:
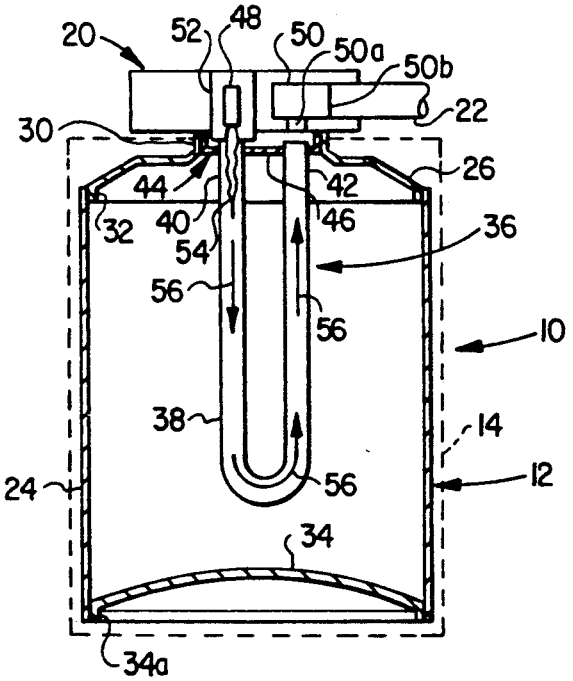
FIG. 4 is a schematic cross-sectional view through the water at a horizontally enlarged scale.

As best illustrated in FIG. 4, the tank structure 12 includes a cylindrical, open-ended body portion 24. At the top end of the body 24 is a top head portion 26 (see FIG. 3 also) having an upwardly domed configuration and a central circular opening 28 bordered by an upturned annular flange 30, and a downwardly extending peripheral lip 32. In constructing the tank 12, the lip 32 is telescopingly inserted into the top end of the tank body 24 and suitably welded therein. At the bottom end of the tank 12 is an upwardly domed bottom head portion 34 having a downwardly extending peripheral lip **34*a* which is fitted into the open lower end of the tank body 24** and suitably welded therein.

Figure 2:
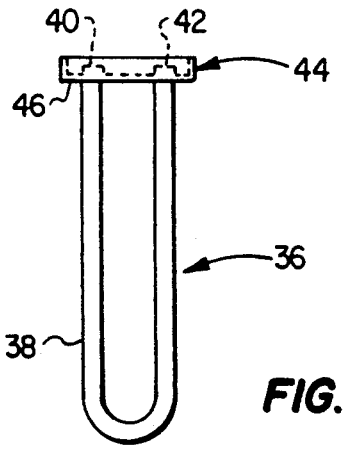
FIG. 2 is a simplified side elevational view of a U-tube heating subassembly portion of the water heater.

The water heater 10 is also provided with a heating subassembly 36, shown in FIGS. 2 and 4, that includes an elongated metal U-tube immersion heating element 38 having open upper end portions 40 and 42, and a cylindrical, generally pan-shaped tube sheet structure 44 with a circular bottom wall 46 and an open top side. The U-tube 38 is conveniently formed from a single, jointless length of circularly cross-sectioned metal tube that is bent to the illustrated U-shape.

In constructing the subassembly 36, the open tube ends 40 and 42 are inserted upwardly through corresponding openings in the bottom tube sheet side wall 46 and welded thereto, and the tube sheet 44 is inserted into the upturned lip 30 (see FIG. 3) and welded thereto to complete the installation of the subassembly 36. In the assembled tank structure 12, the bottom end of the depending U-tube 38 is spaced upwardly from, and is not connected in any manner to, the lower head portion 34 as may be best seen in FIG. 4.

Disposed within the housing 20, which is mounted over the nested tube sheet 44 and annular flange 30, are a shot-type fuel burner 48 and a draft inducer fan 50. Burner 48 is mounted within a subhousing 52 connected to the open top U-tube end 40 within the interior of the tube sheet structure 44 which, as will be seen, also functions as a collection pan for discharged combustion gases. The draft inducer fan 50 has an inlet **50*a* that communicates with the interior of the tube sheet structure 44, and an outlet 50***b* connected to the inlet end of the vent pipe 22.

During operation of the water heater 10, burner 48 (which is supplied in a conventional manner with air and fuel) downwardly discharges a flame 54 into the open U-tube end 40, thereby creating hot combustion gases 56. Operation of the draft inducer fan 50 draws the hot combustion gases 56 through the interior of the U-tube 38 as shown, and then discharges them into the vent pipe 22. Hot combustion gases 56 exiting the open tube end 42 enter the interior of the tube sheet structure 44 before being drawn into the fan inlet 50*a*. The tube sheet structure 44 thus also serves as a combustion gas collection pan as previously mentioned.

Heat from the flame 54 and the hot combustion gases 56 is transferred through the U-tube 38 to the pressurized water disposed in the tank structure 12. Water heated in this manner may be delivered from the tank 12 through a pipe (not shown) connected to a hot water discharge opening 58 (FIG. 1) near the top of the tank. Water discharged in this manner is automatically replaced within the tank via a fill pipe (not shown) connected to a cold water inlet opening 59 near the bottom of the tank.

The water heater 10 provides a variety of fabrication and operational advantages over conventional up-fired water heaters in which a burner is disposed beneath a bottom tube sheet structure, and one or more flue pipes are interconnected between the bottom tube sheet and an upper tube sheet and extended vertically through the tank water to be heated. For example, in the water heater 10 the flame 54 is submerged, and the hot combustion gases 56 make two passes through the tank water. Compared to one pass, up-fired water heaters, this provides the water heater 10 with significantly enhanced fuel use efficiency.

Additionally, only one tube sheet (i.e., the upper tube sheet 44) is used — the water heater 10 does not need a separate bottom tube sheet. Accordingly, this simplifies the fabrication of the heater since the submerged flue structure (i.e., the U-tube 38) only has to be welded to a single tube sheet.

Further, because of the elimination of the bottom tube sheet the in-place process of forming the insulation portion of the exterior jacket structure 14 is considerably simplified since the auxiliary insulation stop structures typically required with conventional up-fired water heaters are eliminated. Also eliminated is the bottom skirt structure required in conjunction with the bottom end burner system in an up-fired water heater. A further advantage of the water heater 10 is that the placement of the burner structure at the top end of the heater automatically positions the heating flame source considerably above any heavier-than-air flammable vapors that may settle around the bottom end of the water heater when it is supported on the floor.

The simplified overall structure of the improved water heater 10 lends itself quite well to mass production since to fabricate the tank structure 12 the single tube sheet portion 44 of the U-tube subassembly 36 is simply slipped into and welded within the flanged top head portion opening 28 either before or after the top end portion 26 is inserted into and welded within the top end of the tank body 24. The inserted U-tube 38 provides a single, jointless immersed heating element within the tank that evenly and efficiently distributes combustion heat along generally the entire height of the tank water. Additionally, the combination tube sheet and combustion gas collection pan structure 44 facilitates the connection of the housing 20 to the balance of the fabricated water heater 10.

Figure 5:
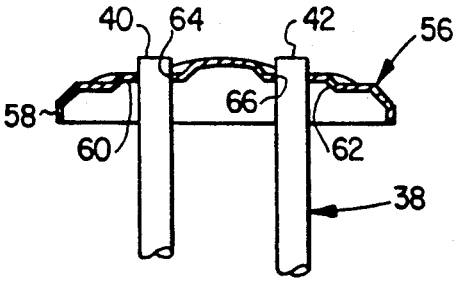
FIG. 5 is a simplified cross-sectional view through an alternate embodiment of the top storage tank end portion operatively connected to the upper ends of a one piece U-tube immersion heating element.

Illustrated in FIG. 5 is an alternate embodiment 56 of the previously described top tank head portion 26 shown in FIG. 3. Like the top head portion 26, the top head portion 56 has an upwardly domed configuration and is provided with a downwardly extending peripheral lip portion 58 configured to be closely received and then welded within the top end of the tank body 24. However, in the top head portion 56 the central flanged opening 28 is omitted and replaced with a spaced pair of flattened areas 60 and 62 in which circular openings 64 and 66 are respectively formed. In this embodiment, the previously described tube sheet 44 is also omitted and the upper ends 40 and 42 are respectively inserted in and welded within the openings 64 and 66. This provides an even simpler two piece structure that combinatively defines both the top end of the storage tank and the combustion gas heating element submerged therein. When this alternate top head portion embodiment is incorporated in the water heater 10, the draft inducer fan inlet 50*a* is connected directly to the open upper end 42 of the U-tube 38.

The illustrated draft inducer fan 50 functions as forced draft means for forcing combustion gases through its associated U-tube immersion heating member as previously described. It will be appreciated that other forced draft means could be utilized in place of the draft inducer fan if desired. For example, a pressurized power burner could be used (in place of the depicted shot-type burner) to positively force the combustion products through the U-tube from its inlet end to its outlet end instead of having them drawn through the U-tube by a draft inducer fan positioned at the outlet end of the U-tube.

The foregoing detailed description is to be clearly understood as being given by way of illustration and example only, the spirit and scope of the present invention being limited solely by the appended claims.

What is claimed is:

1. A down-fired water heater comprising:

a metal tank for storing water, including:

a hollow body having open top and bottom ends, a bottom head portion interengaged with and welded to said bottom end of said tank body, and an upwardly domed top head portion interengaged with and welded to said top end of said tank, said top head portion having an upwardly projecting annular flange extending around a central opening formed in said top head portion;

a tube sheet structure having an open top side, a bottom side wall having spaced apart first and second openings formed therethrough, and an upwardly projecting wall extending around the entire periphery of said bottom side wall, said upwardly projecting peripheral wall of said tube sheet structure being telescopingly received within and welded to said annular top head portion flange;

a U-tube immersion heating member disposed within the interior of said tank, said U-tube immersion heating member being formed from a single length of metal tubing having a cylindrical cross-section along its entire length, said U-tube immersion heating member having first and second open ends upwardly and respectively received in said first and second openings in said bottom side wall of said tube sheet structure, and welded to said bottom side wall of said tube sheet structure, and a curved lower end spaced upwardly apart from said bottom head portion;

burner means operative to downwardly flow a flame, and resulting hot combustion gases, into said first open end of said U-tube immersion heating member; and forced draft means operative to force the combustion gases through said U-tube immersion heating member, and outwardly through said second open end thereof, and then discharge the combustion gases outwardly away from said water heater.

2. The down-fired water heater of claim 1 wherein:

said forced draft means comprise a draft inducer fan having an inlet spaced apart from said second open upper end of said U-tube immersion heating member and operative to withdraw combustion gases from the interior of said tube sheet structure.

3. The down-fired water heater of claim 1 wherein:

said top head portion has a peripheral lip portion telescopingly received within and welded to said top tank body end.

4. The down-fired water heater of claim 1 wherein:

said burner means include a shot-type fuel burner.

5. The down-fired water heater of claim 1 further comprising:

an insulation jacket structure encapsulating said tank.

6. The down-fired water heater of claim 1 further comprising:

a housing positioned above said top head portion, said burner means and said draft inducer fan means being operatively disposed in said housing.

7. A method of manufacturing a down-fired water heater comprising the steps of:

providing a metal water storage tank body having open top and bottom ends;

providing an upwardly domed metal top head portion having a central opening bordered by an upwardly projecting flange;

providing a metal bottom head portion;

interengaging said bottom head portion and said bottom tank body end;

welding the interengaged bottom head portion and bottom tank body end together;

providing a generally pan-shaped tube sheet structure having an open top side, and a bottom side wall having spaced apart first and second openings therein:

forming a U-tube immersion heating member from a single length of metal tubing having a cylindrical cross-section along its length, said U-tube immersion heating member having first and second open upper ends and a curved bottom end;

inserting said first and second open upper ends of said U-tube immersion heating member upwardly and respectively into said first and second openings in said bottom side wall of said tube sheet structure;

welding the inserted first and second open upper ends of said U-tube immersion heating member to said bottom side wall of said tube sheet structure;

interengaging said top head portion and said top tank body end;

welding the interengaged top head portion and top tank body end together;

operatively associating burner means with said first open upper end of said U-tube immersion heating member, said burner means being operative to downwardly flow a flame, and resulting hot combustion gases, into said first open end of said U-tube immersion heating member; and operatively associating forced draft means with said U-tube immersion heating member, said forced draft means being operative to force the combustion gases through said U-tube immersion heater member, and outwardly through said second open upper end thereof, and then discharge the combustion gases outwardly away from said water heater.

8. The method of claim 7 wherein said step of operatively associating forced draft means with said U-tube immersion heating member is performed by:

operatively associating draft inducer fan means with said second open upper end of said U-tube immersion heating member, said draft inducer fan means being operative to draw the combustion gases through said U-tube immersion heating member, and outwardly through said second open upper end thereof, and then discharge the combustion gases outwardly away from said water heater.

9. The method of claim 7 wherein:

said step of operatively associating burner means with said first open upper end of said U-tube immersion heating member is performed using a shot-type fuel burner.

10. The method of claim 8 wherein:

said step of operatively associating draft inducer fan means with said second open upper end of said U-tube immersion heating member includes the step of positioning the inlet of a draft inducer fan in a spaced apart relationship with said second open upper end of said U-tube immersion heating member and communicating with the interior of said tube sheet structure so as to withdraw therefrom combustion gases exiting said second open upper end of said U-tube immersion heating member during operation of the draft inducer fan.

11. The method of claim 7 wherein:

said step of interengaging said top head portion and said top tank body end is performed by inserting a peripheral portion of said top head portion into said top tank body end.

12. A down-fired water heater comprising:

a metal tank for storing water, including:

a hollow body having open top and bottom ends, a bottom head portion interengaged with and welded to said bottom end of said body, and a top head portion interengaged with and welded to said top end of said body, said top head portion having spaced apart first and second openings extending upwardly therethrough;

a U-tube immersion heating member disposed within the interior of said tank, said U-tube immersion heating member being formed from a single length of metal tubing having a cylindrical cross-section along its length, said U-tube immersion heating member having first and second open upper ends respectively received in said first and second openings in said top head portion, and welded to said top head portion, and a curved lower end spaced upwardly apart from said bottom head portion;

burner means operative to downwardly flow a flame, and resulting hot combustion gases, into said first open end of said U-tube immersion heating member; and forced draft means operative to force the combustion gases through said U-tube immersion heating member and outwardly through said second open upper end thereof, and then discharge the combustion gases outwardly away from said water heater.

13. The down-fired water heater of claim 12 wherein:

said forced draft means comprise a draft inducer fan connected to said U-tube immersion heating member.

14. The down-fired water heater of claim 12 wherein:

said top head portion has an upwardly domed configuration with spaced apart first and second flattened portions formed thereon, and said first and second openings in said top head portion respectively extend through said first and second flattened portions.

15. The down-fired water heater of claim 14 wherein:

said top head portion has a downwardly extending peripheral lip portion telescopingly received within said top tank body end, and said peripheral lip portion is welded to said top tank body end.

16. The down-fired water heater of claim 12 further comprising:

an insulation jacket structure outwardly overlying said tank body, said top head portion, and said bottom head portion.

17. A method of manufacturing a down-fired water comprising the steps of:

providing a metal water storage tank body having open top and bottom ends;

providing a top head portion having a peripheral portion and spaced first and second openings positioned inwardly of said peripheral portion;

forming a U-tube immersion heating member from a single length of metal tubing having a cylindrical cross-section along its length, said U-tube immersion heating member having first and second open upper ends and a curved bottom end;

inserting said first and second open upper ends of said U-tube immersion heating member respectively into said first and second openings in said top head portion in a manner such that said U-tube immersion heating member projects downwardly from said top head portion;

welding the inserted first and second open upper ends of said U-tube immersion heating member to said top head portion;

welding said peripheral portion of said top head portion to said top tank body end;

providing a bottom head portion having a peripheral portion;

welding said peripheral portion of said bottom head portion to said bottom tank body end;

operatively associating burner means with said first open upper end of said U-tube immersion heating member, said burner means being operative to downwardly flow a flame, and resulting hot combustion gases, into said first open upper end of said U-tube immersion heating member; and operatively associating forced draft means with said U-tube immersion heating member, said forced draft means being operative to force combustion gases through said U-tube immersion heating member, and outwardly through said second open upper end thereof, and then discharge the combustion gases outwardly away from said water heater.

18. The method of claim 17 further comprising the steps of:

forming spaced apart first and second flattened areas on said top head portion, and respectively positioning said first and second openings in said first and second flattened areas.

19. The method of claim 17 wherein:

said peripheral portion of said top head portion is a downwardly projecting peripheral lip, said method further comprises the step of telescopingly inserting said peripheral lip into said top tank body end, and said step of welding said peripheral portion of said top head portion to said top tank body end is performed by welding the inserted peripheral lip to said top tank body end.

20. The method of claim 17 further comprising the step of:

outwardly covering said tank body, said top head portion, and said bottom head portion with an insulation jacket structure.

* * * * *